US005312189A

United States Patent [19]

Aeschbach et al.

[11] Patent Number: 5,312,189

[45] Date of Patent: May 17, 1994

[54] BAG MADE OF FOIL MATERIAL AND A METHOD OF PRODUCING SUCH A BAG

[75] Inventors: Rudolf Aeschbach; Martin Wiesmann, both of Schweiz, Switzerland

[73] Assignee: Cellpack AG, Switzerland

[21] Appl. No.: 884,522

[22] Filed: May 15, 1992

[30] Foreign Application Priority Data

May 16, 1991 [DE] Fed. Rep. of Germany ..... 4115923

[51] Int. Cl.[5] ..... B65D 33/38

[52] U.S. Cl. ..... 383/207; 383/906

[58] Field of Search ..... 383/202, 207, 209, 904, 383/906, 208, 104, 33, 35; 604/408

[56] References Cited

U.S. PATENT DOCUMENTS

| | | | |
|---|---|---|---|
| 3,074,612 | 1/1963 | Schneider | 383/906 X |
| 3,171,581 | 3/1965 | Kugler | 383/209 X |
| 3,520,471 | 7/1970 | Faust | 383/906 X |
| 3,799,914 | 3/1974 | Schmit et al. | 383/200 X |
| 4,119,128 | 10/1978 | Bishop | 383/200 X |
| 4,301,800 | 11/1981 | Collins | 604/408 X |
| 4,365,629 | 12/1982 | Pert et al. | 604/408 |
| 4,559,053 | 12/1985 | Porges | 604/408 |

FOREIGN PATENT DOCUMENTS

| | | | |
|---|---|---|---|
| 299562 | 1/1989 | European Pat. Off. . | |
| 0368145 | 5/1990 | European Pat. Off. | 383/200 |
| 0368757 | 5/1990 | European Pat. Off. | 383/104 |
| 8805013 | 7/1988 | PCT Int'l Appl. . | |
| 2111944 | 7/1983 | United Kingdom | 383/202 |

*Primary Examiner*—Allan N. Shoap
*Assistant Examiner*—Jes. F. Pascua
*Attorney, Agent, or Firm*—Allegretti & Witcoff, Ltd.

[57] ABSTRACT

The bag includes at the area of a corner or a projection a pouring structure which is in part enclosed by a seam. The pouring structure includes a channel and a tube located in the channel in order to prevent a collapsing of the channel and to channel the discharging of the contents of the bag.

4 Claims, 2 Drawing Sheets

BAG MADE OF FOIL MATERIAL AND A METHOD OF PRODUCING SUCH A BAG

BACKGROUND OF THE INVENTION

The present invention relates to a bag made of a foil material and having two sidewalls and a bottom, which sidewalls are interconnected at their edges by a longitudinal seam, having further a pouring channel structure located at one corner area of the bag and arranged inside a seam which closes the corner area off in such a manner that by a severing at the corner area the contents of the bag can be discharged, which seam closing the corner area off is structured at the corner area in such a manner that the pouring channel structure is at least partly surrounded by the seam in order to keep the pouring opening at the pouring channel structure after a severing at the corner area at a stable position.

It also relates to a bag made of a foil material and having two sidewalls and a bottom, which sidewalls are interconnected at their edges by a longitudinal seam, having further a pouring channel structure located at an edge area of the bag and arranged inside a seam which closes the edge area off in such a manner that by a severing at the edge area the contents of the bag can be discharged, which seam at the edge area is structured in such a manner that the pouring channel structure is at least partly surrounded by the seam in order to keep the pouring opening at the pouring channel structure after a severing at the edge area at a stable position.

The invention relates further to a method of producing a bag made of a foil material and having two sidewalls and a bottom, which sidewalls are interconnected at their edges by a longitudinal seam, having further a pouring channel structure located at one corner area of the bag and arranged inside a seam which closes the corner area off in such a manner that by a severing at the corner area the contents of the bag can be discharged, which seam closing the corner area off is structured at the corner area in such a manner that the pouring channel structure is at least partly surrounded by the seam in order to keep the pouring opening at the pouring channel structure after a severing at the corner area at a stable condition, which pouring channel structure includes a channel formed in at least one of the sidewalls as a pre-shaped groove like recess, and includes a tube located in the pre-shaped channel, whereby a collapsing of the pouring channel structure is prevented and the discharging of the contents of the bag is channelled through the tube, and which bag is made of a thermoplastically deformable material.

It relates further to a method of producing a bag made of a foil material and having two sidewalls and a bottom, which sidewalls are interconnected at their edges by a longitudinal seam, having further a pouring channel structure located at an edge area of the bag and arranged inside a seam which closes the edge area off in such a manner that by a a severing at the edge area the contents of the bag can be discharged, which seam at the edge area is structured in such a manner that the pouring channel structure is at least partly surrounded by the seam in order to keep the pouring opening at the pouring channel structure after a severing at the edge area at a stable condition, which pouring channel structure includes a channel formed in at least one of the sidewalls as pre-shaped groove like recess, and includes a tube located in the pre-shaped channel, whereby a collapsing of the pouring channel structure is prevented and the discharging of the contents of the bag is channelled through the tube, and which bag is made of a thermoplastically deformable material.

DESCRIPTION OF THE PRIOR ART

Known bags of the kind set forth above include a pouring structure which is arranged at the area of a corner of the bag in such a manner that the bags can be opened by a severing of an edge of corner area thereof.

When emptying such bags or discharging their contents, respectively, the entire bag collapses. The discharging proceeds accordingly without any air entering the bag; this in contrast to containers having a rigid hollow body. Problems encountered during the discharging arise only at an area around the discharge opening. If, for instance, a channelling of the discharge is produced by e.g. welding procedures, the walls of the bags collapse in and upstream of such channelling, whereby a discharging is prevented.

The European specification EP-A-368 145 discloses various kinds of such bags which include measures to avoid such a collapsing as far as possible.

According to a first design of such known bags such as disclosed in FIGS. 1 and 2 of the EP-A-368145 groove shaped recesses were formed in the two sidewalls by a deep drawing, which recesses form a channel enclosed by welding seams. The channel is arranged to extend at an angle of 45° relative to the edges at the corner area. Its outer end is closed by the edges of the foils which are connected to each other and its inner end communicates with the inner space of the bag. It is, however, a proven fact that the sales personnel or the shoppers of such bags grip these bags when handling same at the corner edge where the deep drawn channel is located. This leads to a pressing together of the channel and again to a collapsing at the discharge area. The EP-A-364 373 discloses a similar solution.

According to a second kind of such known bags, for instance in accordance with FIG. 3 of the EP-A-368 145 a channel is formed solely by a discharge tube, which is placed extending parallel to the longitudinal edge 4 between the front and back sidewall of the bag and is welded therein. A pre-shaped channel by a deep drawing of the parts of the foil is here not present. At this solution the discharge tube, in order to keep it maintaining its position, is placed against the welding seam of the longitudinal edge 4 between the foil parts and thereafter the foil parts are welded together by a longitudinal seam at the opposite longitudinal sides of the discharge tube, whereby the foil parts are pulled as snugly as possible over the discharge tube and the welding seam is to be placed as close as possible at the discharge tube.

Such a design has drawbacks. The placing of the last named welding seams close to the tube and to arrive at a sealed state is rather difficult to produce. It is possible that folds are produced in the foil parts. It also would be technically quite complicated to located at the last named solution the channel similar to the initially mentioned solution obliquely because in such a case means for maintaining the position of the discharge tube would be missing. In order to secure a good outflow of the contents of the container the diameter of the discharge tube, specifically in case highly viscous liquids should not be too small. In case of discharge tubes which for above reason have a suitable and according larger diameter it is possible, that due to a stretching of the foil parts ruptures are produced in the foil parts or the tubes are pressed flat if the longitudinal welding seam is placed as is desired as close as possible at the tube. In order to prevent a rupturing or tearing, respectively, of the foil parts a thicker foil would have to be selected for the bag. Due to the desire to save on foil material, this is not desirable.

The Swiss specification CH-PS 677 093 discloses a further solution which should solve as much as possible the above mentioned drawbacks. According to this solution a complicated injection molded member is welded into the upper end of the foil bag, which keeps the foil walls from each other by means of wings and includes a discharge channel. The complicated injection molded part which must be produced separately renders the entire bag more expensive.

SUMMARY OF THE INVENTION

Accordingly, it is a general object of the present invention to provide an as simple as possible solution together with minimal requirements regarding raw material for preventing the collapsing of the foil parts at the area of the discharge structure and to arrive at an unequivocally defined channelling of the discharging of the contents of the bag.

A further object is to provide a bag in which the pouring channel structure comprises a channel formed in at least on of the sidewalls as a pre-shaped groove like recess, and a tube located in the pre-shaped channel, whereby a collapsing of the pouring channel structure is prevented and the discharging of the contents of the bag is channelled through the tube.

Still a further object is to provide a method of producing a bag made of a foil material, according to which a channel shaped structure is shaped initially by a deep-drawing process into the plastic foil forming the side wall or side walls, respectively, of the bag, whereafter the tube is placed into the produced channel shaped structure.

Thus, the pre-shaped recess formed in one or in the two oppositely located foil parts in order to form the discharge channel are produced by a deep drawing. The tube which is placed into the recess and fixedly held therein can be a plastic tube generally available on the market.

The tube placed into the recess or recesses, respectively, reinforces the zone in the area of the pouring out structure and prevents a collapsing. It is no longer necessary to select the thickness of the foil of the bag depending on the loading thereof in the zone of the pouring out structure. The thickness can be selected now merely based on the loading by the contents of the bag and accordingly can be made thinner. This allows a saving on raw material. On the other hand, the tube is no longer overloaded when finally producing the pouring out area and it is possible to use a cheap tube which is generally available, of which the inner diameter is now selected only based on the desired outflow properties of the contents of the container and can preferably be selected to be as large as possible for highly viscous liquids. Thus, the bag can be produced from a relatively thin foil material, in which merely a tube section is embedded as foreign body.

The recess in the walls of the bag must not follow at all places the contour of the inserted tube. The recess can have also any kind of suitable shapes which cause still further improvements against a collapsing of the walls of the bag at the discharge zone. For this reason, a bulge is arranged relative to the pouring direction of the contents upstream of the end of the tube located inside of the bag, which bulge has a form of a hollow space and is somewhat broader than the tube, whereby the inner end of the tube opens into this bulge which is embossed in at least one of the side walls of the bag in order to prevent a closing or blocking, respectively, of the inlet area to the tube by a collapsing. The bag is generally emptied completely, i.e. its contents are poured out completely during the first use. The space caused by the filled-in commodity and the hollow space formed in the walls of the bags by the bulge at the tube run into each other, i.e. communicate wherewith a discharging of the contents of such container after having opened the bag can proceed without the risk of a collapsing of the walls of the bag at the area of inflow into the discharge channel structure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

A bag of the kind referred here into consists of a thermoplastically deformable plastic foil which has been cut in such a manner that the side walls 1 and 2 and a W-shaped folded bottom (see also EP-O 368 145 and EP-O 364 373) are produced, which walls are interconnected at their edges 3 by a welding, adhesive agents, hot sealing, etc., in order to produce a closed bag having a filling space for liquid contents between the walls 1 and 2. It is not necessary to have the bag produced from one integral foil. It is for instance possible to produce the bottom of the bag from a separate foil of a same or different quality and/or thickness than for the walls. The bag includes, furthermore, at its corners at the area of its folded bottom corner seams. These corner seams extend over the corners and connect a section of the folded bottom to the immediately opposite section of the front and back wall, respectively. By this procedure, the outer folded edges form the edges on which the filled bag stands. In order to improve the standing stability, the immediately adjacently located sections of the folded bottom are connected to each other preferably by obliquely extending standing corner seams.

This bag is now equipped with a discharging structure which can be designed variously, such as disclosed here below.

In the illustrations of the FIGS. 1, 3, 5, 7 and 8, a part of the upper side wall 2 is left off.

Figure 1:
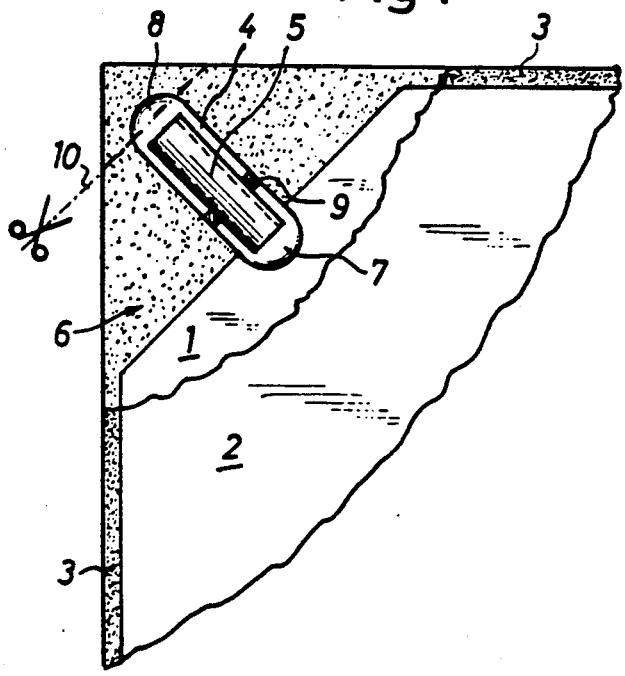
FIG. 1 is a plan view of a corner area of a first embodiment of the inventive bag.

The pouring-out structure or discharge structure illustrated in FIG. 1 includes a pouring channel 4 and a tube 5 which is arranged in the pouring channel 4. The pouring channel 4 is formed in two halves by respective groove-like recesses formed in the side walls, 1, 2. The pouring channel 4 is enclosed by a seam 6 extending over the corner section in such a manner that the upstream end of the pouring channel 4 (relative to the flow direction of the contents of the bag when discharged) is located outside of this seam 6 and forms an inlet section 7. The dimensions of the tube 5 are selected in such a manner that adjacent to the inlet section 7, an outflow section 8 of about the same size is present at the downstream end of the tube 5. The tube 5 is attached to the side wall foils at the locations identified by the reference numeral 9. Furthermore, a line 10 is illustrated at the outer surfaces of the bag, which is identified by a scissors symbol, along which line 10, a corner portion can be severed from the rest of the bag in order to open the bag.

When viewing FIG. 1, it becomes obvious that after having severed the corner, the contents of the bag are discharged through the tube 5 at a uniform flow. FIG. 1 reveals also that the user may perceive by the location of the tube 5 an indirect reference to the severing line in case the user does not take notice of the line when opening the bag. By this means, an improper opening of the bag can be largely prevented.

Figure 2:
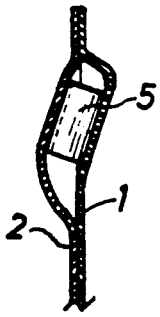
FIG. 2 is a section taken through the discharge or pouring opening of FIG. 1.

Instead of the groove-shaped recess, it is also possible to provide nose-shaped recesses according to FIG. 2 in the side walls 1, 2, in which recesses the tube 5 is located and held.

Figure 3:
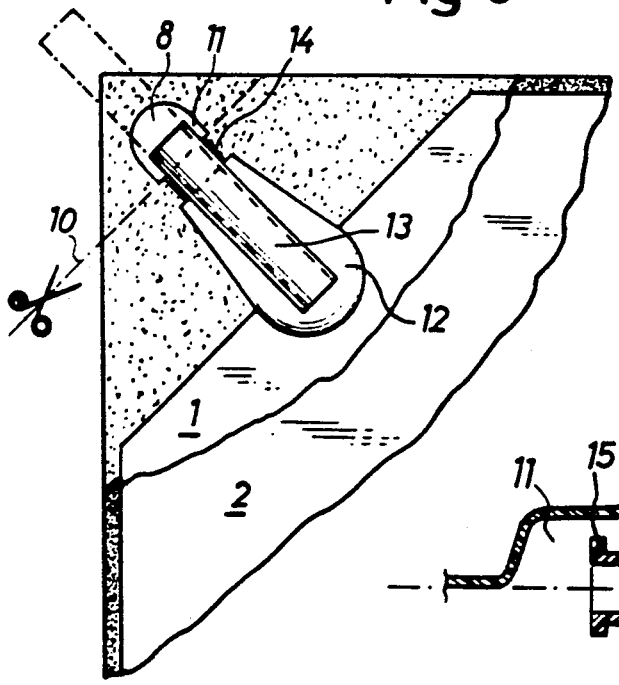
FIG. 3 is a plan view of a corner area of a second embodiment of the inventive bag.
Figure 4:
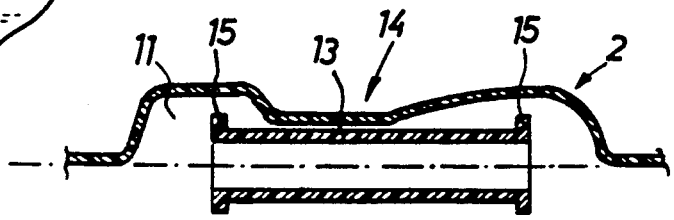
FIG. 4 is a longitudinal section through the pouring spout of FIG. 3 on a somewhat enlarged scale.

FIG. 3 and 4 illustrate a second embodiment of the pouring out structure for the inventive bag.

This pouring out structure includes a pouring channel 11 and a tube 13, which is located in the pouring channel 11. The upstream end of the channel 11 opens into a pear-shaped space 12. The channel 11 and the space 12 are formed by respective recesses in the side walls 1, 2, each forming a half of the channel and of the space. The tube 13 is arranged in the channel 11 in such a manner that the outflow section 8 is formed at the downstream end of the tube 13, and that the upstream end of the tube 13 projects into the pear-shaped space 12 which forms an inlet section.

FIG. 4 illustrates specifically that the tube 13 is held against movement in axial direction in an area 14 of the channel 11, which borders the space 12. The seam 6 in this area 14 is secured tightly onto the wall of the channel 11 such that the tube 13 is guided. The tube 13 includes at both its ends a bead or flange 15 to secure the tube 13 against removal.

The severing line 10 of this embodiment is located so that after the opening of the bag it is possible to grip the tube 13. The substantial advantage of this inventive solution is that after the tube 13 has been pulled out, a discharge spout is produced for discharging the contents of the bag, for instance into another container. Pouring is facilitated without losing the advantages of a smooth flow.

Figure 5:
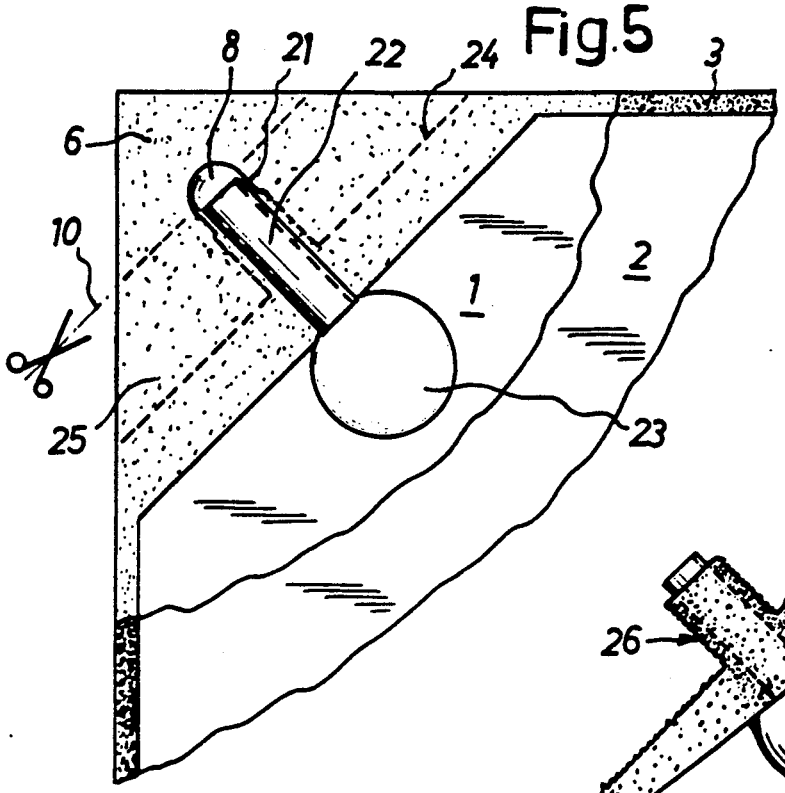
FIG. 5 is a plan view of a corner area of a third embodiment of the inventive bag.
Figure 6:
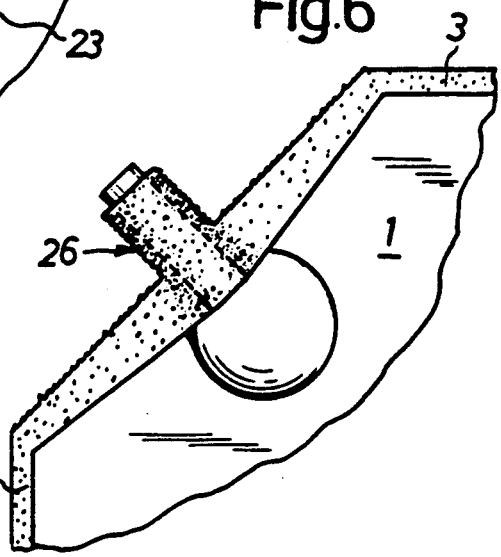
FIG. 6 is a plan view of the corner area of the bag shown in FIG. 5 in a ready-to-use state.

FIGS. 5 and 6 illustrate a third embodiment of the pouring-out structure for the inventive bag.

Similar to the above disclosed embodiments, the pouring-out structure includes a pouring channel 21 and a tube 22 which is located in the channel 21. The upstream, inner end of the channel 21 opens into a lentil or lens shaped space 23. The channel 21 and the space 23 are formed by opposed recesses in the side walls 1, 2, each forming half of the channel and space, respectively. The tube 22 is located in the channel 21 in such a manner that the outflow section 8 is formed at the downstream end of the tube 22 and that the upstream end of the tube 22 projects into the lentil-shaped space 23, which forms an inlet section. The severing line 10 is arranged in this embodiment in such a manner that it runs directly across the downstream end of the tube 22. Furthermore, a perforation 24 can be located at the corner area so that a spout 26 can be produced by tearing off the section 25 as illustrated in FIG. 6.

Figure 7:
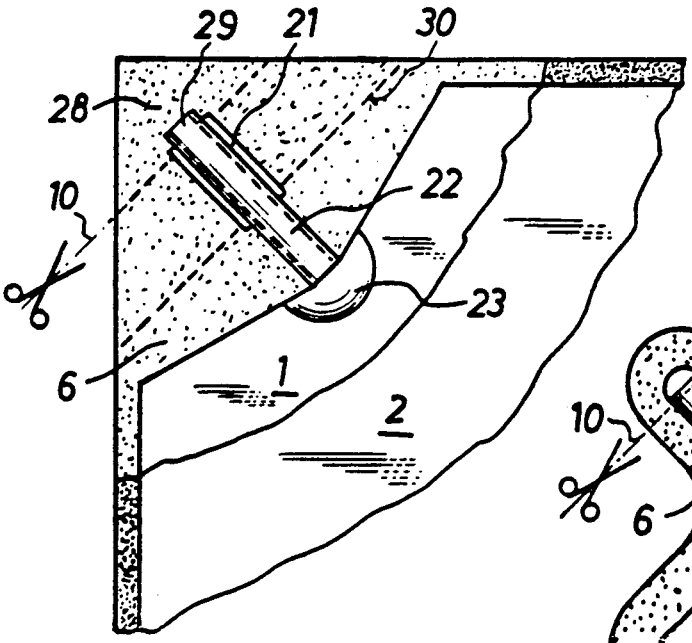
FIG. 7 is a plan view of a corner area of a fourth embodiment of the inventive bag.

FIG. 7 illustrates a fourth embodiment of a pouring structure for the inventive bag.

This pouring structure is like the structure illustrated in FIG. 5 and includes a pouring channel 21 and a tube 22 which is disposed in the pouring channel. The pouring channel 21 opens at its upstream into a lentil-shaped space 23. The tube 22 is connected at its circumference near its upstream end to the side walls 1, 2 by the seam 6 and is closed at its downstream end by the seam 6. Between these two areas the tube 22 lies freely in the pouring channel 21. The severing line 10 is located in such a manner that when opening the bag a section 29 of the tube 22 is severed in addition to the corner section 28 of the bag. Furthermore, a perforation 30 is provided, which ends in that area where the tube 22 is disposed freely in the pouring channel 21.

In order to properly open the bag, the perforation is firstly torn and thereafter the bag is cut along the severing line 10. This procedure produces a spout similar to the spout illustrated in FIG. 6.

Figure 8:
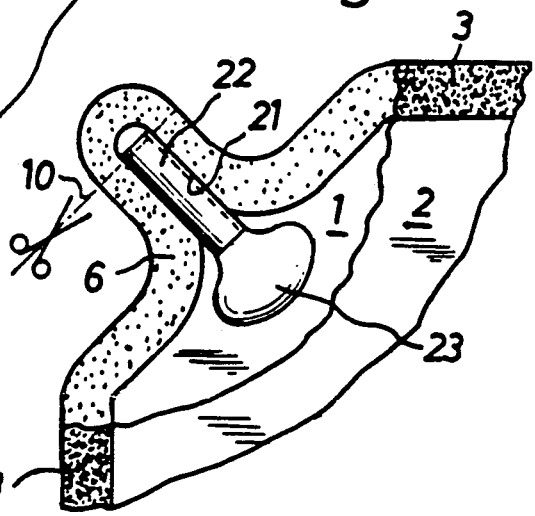
FIG. 8 is a plan view of a corner area of a fifth embodiment of the inventive bag.

The corner area of the embodiment illustrated in FIG. 8 is punched out in a beak-like shape and the corner seam follows the beak-like contour of the projecting edge area. The design is otherwise similar to the designs of FIGS. 5 and 6, and same parts or areas, respectively, have the same reference numerals. The tube 22 extends along the complete preshaped channel 21 and contacts tightly the channel walls along this length. The hollow space 23 formed into the side walls 1 and 2 has the shape roughly of a bean and opens at a somewhat contracted section directly into the inflow end of the tube 22.

The embodiment according to FIG. 8 can also be equipped with an angled channel and tube and/or with a shut-off pack.

When producing the illustrated bags, the foil walls made of a thermoplastic plastic material are heated and thereafter the pouring channel 4, 11 or 21 and the adjacent hollow space 12 or 23 is formed according to generally known procedures by a deep-drawing method such as by vacuum, pressurized air and/or punches into the heated foil walls. Thereafter, the cylinder-shaped plastic tube 5, 13 or 22 is placed into the pre-shaped pouring channel and the welding seam 6 extending over the corner area and the other seams 3 are formed with the exception of an area needed for the filling in of the contents of the bag. In the embodiments according to FIGS. 1, 5, 7 and 8, the tube placed into the corresponding channels is spot-welded in the pouring channel to the side walls in order to arrest and secure the tube threat.

In order to prevent a residual liquid or a considerable amount of residual liquid remaining in the bag after the contents of the bag have been poured out through the tube 5, 13 or 22, the inner end of this tube ends preferably about at the inner limit of the corner or edge seam 6. In order to secure a free flow of the contents of the bag to the tube 5 when pouring its content out, the pouring channel is elongated towards the inside relative to the seam 6 as illustrated in FIG. 1 by the reference numeral 7; or a bulge or hollow space is located ahead of the pouring channel or tube, as illustrated in FIG. 3 by the reference numeral 12 and in FIGS. 5, 7 and 8 by the reference numeral 23, which bulge or hollow space is in proper communication with the tube 22. The bag is filled by its contents up to roughly the height of the corner seams. The elongation 7 of the pouring channel according to FIG. 1, and the bulges or hollow spaces 12, 23 according to FIG. 3 or FIGS. 5, 7 and 8, respectively, produce a free communication between the tube 5 and the content receiving space of the bag. A collapsing of the walls of the bag ahead of the entry into the tube is prevented by this measure. The flow into the tube 22 is improved by the hollow space 23 according to FIGS. 5–8, which space converges towards the inlet end of the tube 22. FIG. 8 illustrates also the embodiment in which the pouring structure is not located at a corner of the bag, but is rather shaped as a beak-like projection at any suitable edge section of the bag.

Should it not be desired to completely discharge the contents of the bag at one use, a close-off peg can provided which can be inserted into the outer end of the pouring channel or tube.

While there are shown and described the present preferred embodiments of the invention, it is to be distinctly understood that the invention is not limited thereto, but may be otherwise variously embodied and practiced within the scope of the following claims.

What is claimed is:

1. A generally rectangular collapsible bag made of thin flexible foil material and having a sealed pouring channel at one corner thereof which corner can be severed to permit expelling the contents of the bag comprising:

two flat flexible side walls interconnected at their edges by a peripheral seam to provide a filling space therebetween, a pouring channel structure located at said one corner of the bag comprising:

a downstream end remote from said filling space and an upstream end near said filling space, a preshaped recess formed in said side walls to provide a hollow space having a cylindrical portion terminating in a bulge portion at the upstream end thereof, a seam extending across said one corner surrounding the cylindrical portion of said recess joining segments of said peripheral seam adjacent said one corner, said bulge ballooning radially from said cylindrical portion and projecting beyond the confines of said corner seam into said filling space, a reinforcing tube disposed in said cylindrical portion of said hollow space communicating freely with said bulge portion, whereby, when said one corner is severed said preshaped bulge portion of said pouring channel prevents collapse of said flat walls adjacent the upstream end of said tube so that the contents of the bag will flow freely from said filling space into said bulge portion and through said tube.

2. The bag of claim 1 in which said corner seam is perforated diagonally across said pouring channel to permit tearing off the one corner to expose the downstream end of said pouring channel.

3. The bag of claim 1 in which said corner seam is perforated around the outer boundary of said pouring channel so that after severing along the perforation, the downstream end of said pouring channel is enclosed in a narrow seam having a rounded end.

4. The bag of claim 1 in which said tube is removable from the downstream end of said cylindrical portion of said hollow space after the corner has been severed, said tube having a radially-extending flange on each end and said cylindrical portion of said hollow space having a central segment of smaller diameter than the diameter of said flanges to prevent the tube from sliding out of said cylindrical portion prior to severing the corner.

* * * * *